US005867951A

United States Patent [19]

Yaguchi et al.

[11] Patent Number: 5,867,951

[45] Date of Patent: Feb. 9, 1999

[54] SEISMIC ISOLATION SLIDING BEARING FOR STRUCTURE

[75] Inventors: Daisuke Yaguchi, Ichikawa; Hiroshi Kurabayashi, Tokyo; Toshio Omi, Sakura; Nobuyuki Sone, Yamato; Takeshi Someya, Kashiwa; Hirokazu Hora, Ichihara; Akira Matsuda, Ichikawa; Takafumi Fujita, 575-28, Nakanokuki, Nagareyama-shi, Chiba, all of Japan

[73] Assignees: Mitsubishi Steel Mfg. Co., Ltd., Tokyo; Takafumi Fujita, Chiba, both of Japan

[21] Appl. No.: 865,207

[22] Filed: May 29, 1997

[30] Foreign Application Priority Data

Jun. 14, 1996 [JP] Japan ..... 8-153917
Apr. 11, 1997 [JP] Japan ..... 9-093774

[51] Int. Cl.[6] ..... E02D 27/34; E04H 9/02

[52] U.S. Cl. ..... 52/167.4; 52/167.9

[58] Field of Search ..... 52/167.4, 167.5, 52/167.9

[56] References Cited

U.S. PATENT DOCUMENTS 4,644,714 2/1987 Zayas ..... 52/167.4
4,974,378 12/1990 Shustov ..... 52/167.5
5,071,261 12/1991 Stuve ..... 52/167.5 X
5,438,807 8/1995 Shustov ..... 52/167.4

FOREIGN PATENT DOCUMENTS 666266 6/1979 U.S.S.R. ..... 52/167.5

*Primary Examiner*—Christopher Kent
*Attorney, Agent, or Firm*—Flynn, Thiel, Boutell & Tanis, P.C.

[57] ABSTRACT

A seismic isolation sliding bearing for a structure, is made up of a dish 1 having a conical concave surface having a predetermined inclination or a spherical concave surface in its central portion, and a bearing element 2 in which the bearing element includes a base 3 whose portion for contact with the concave surface of the dish 1 is formed by a low-friction material, and a holder 6 which holds the base 3 so as to press it against the concave surface of the dish 1. The seismic isolation sliding bearing of the present invention neither resonates to the vibration period of any earthquake nor causes a large oscillation during a normal small vibration, but has a restoring force because of its structure which enables the bearing element to readily return to its original position after an earthquake ceases.

12 Claims, 12 Drawing Sheets

SEISMIC ISOLATION SLIDING BEARING FOR STRUCTURE

BACKGROUND OF THE INVENTION

1. Field of the Invention

The present invention is intended to provide a seismic isolator or tuned mass damper for a structure, particularly, a seismic isolator which can effect seismic isolation and vibration control by employing a bearing element using a low-friction material and a dish having a conical concave surface or a spherical concave surface in its central portion.

2. Description of the Prior Art

A seismic isolator has heretofore been proposed in which the concave surface of a dish and a bearing element are maintained into contact with each other. This prior art device has a structure in which even if the bearing element and the contact surface (concave surface) of the dish is relatively displaced by a horizontal movement, the surface pressure of the contact surface is kept constant at all times, and the concave surface of the dish body is formed as a spherical surface. For example, as shown in FIG. 11, a bearing element 2 joined to a medium 9 is combined with a dish 1 having a spherical concave surface 1*a* in such a manner as to press a low-friction material (fluorocarbon resin) 5 against the dish 1, and a structure is placed on the bearing element 2.

The low-friction material 5 has a spherical shape so that it can rotate about the joint surface of the medium 9. If a strong earthquake occurs and a vibration having an acceleration of not less than the product of the coefficient of friction of the low-friction material and acceleration of gravity acts to relatively slide the dish 1 and the bearing element 2, the low-friction material 5 rotates in the medium 9 of the bearing element i, and can slide with the surface pressed against the concave surface of the dish 1. At this time, if the low-friction material 5 lies at a position offset from the center of the dish 1, since the low-friction material 5 always lies at a position higher than the central portion of the dish 1, a force which tends to return to a lower position owing to gravity acts on the low-friction material 5 as a restoring force, so that the low-friction material 5 returns to the original central portion.

The structure of the prior art is such that when a horizontal movement occurs due to an earthquake, the restoring force is obtained on the principle of a pendulum. Accordingly, in the case of a seismic wave having a predetermined period and a long period component (for example, the seismic wave of the Hachinohe earthquake), the conventional seismic isolator resonates and may not be able to achieve an expected seismic isolation effect.

To avoid this resonance, it may be considered to increase the radius of curvature of the dish and extend the natural period thereof. However, this leads to the problem that the restoring force becomes small and the low-friction material becomes difficult to restore to its original position after an earthquake ceases.

Although there are many examples which use a fluorocarbon resin as their low-friction materials, the fluorocarbon resin has creep characteristics and hence low wear resistance, and is inferior in durability.

SUMMARY OF THE INVENTION

An object of the present invention is to provide a seismic isolator which has a structure that allows response acceleration to level off with respect to any kind of earthquake and which has no oscillation during a normal earthquake owing to friction and does not cause a large wear during oscillation, unlike a fluorocarbon resin, because a thermoplastic resin is used.

The present invention for solving the above problem provides a seismic isolation sliding bearing, which is a sliding bearing for the isolation of seismic vibrations in a structure, as set forth below. Specifically, the present invention provides the following seismic isolation sliding bearings.

(1) A seismic isolation sliding bearing for a structure, comprising a dish (bearing plate) having a conical concave surface having a predetermined inclination, and a bearing element opposed to the dish, the bearing element including a low-friction material fixed to one end of its base, and a holder which holds the base so as to press the low-friction material against the concave surface of the dish.

(2) A seismic isolation sliding bearing for a structure according to paragraph (1), wherein the top of the bearing element has a truncated shape which is inclined at a predetermined degree and enables a trigger value to be set during a normal state.

(3) A seismic isolation sliding bearing for a structure, comprising a dish (bearing plate) having a spherical concave surface in its central portion and a trapezoidal concave surface inclined by a predetermined degree around the spherical concave surface, and a bearing element opposed to the dish, the bearing element including a base made of a low-friction and wear-resistant thermoplastic resin and having a spherical convex sliding surface, and a holder which holds the base so as to press the base against the concave surface of the dish.

(4) A seismic isolation sliding bearing for a structure according to paragraph (3), wherein the concave surface of the dish which is inclined by the predetermined degree is perpendicular to a vector which extends to a spherical orbit from the center of the spherical concave surface which lies in the central portions of the dish.

(5) A seismic isolation sliding bearing for a structure according to any of paragraphs (1) through (4), wherein the sliding bearing has an elastic member at a bottom of the dish (bearing plate) or at a bottom of the base of the bearing element.

(6) A seismic isolation sliding bearing for a structure according to any of paragraphs (1) through (4), wherein the sliding bearing has a laminated rubber member at a bottom of the dish (bearing plate) or at a bottom of the base of the bearing element.

(7) A seismic isolation sliding bearing for a structure according to any of paragraphs (1) through (6), wherein the concave surface of the dish is made of smooth stainless steel and the reverse side of the concave surface has a reinforcement material made of concrete or a high-strength resin.

DETAILED DESCRIPTION OF THE PREFERRED EMBODIMENTS

Figure 5A:
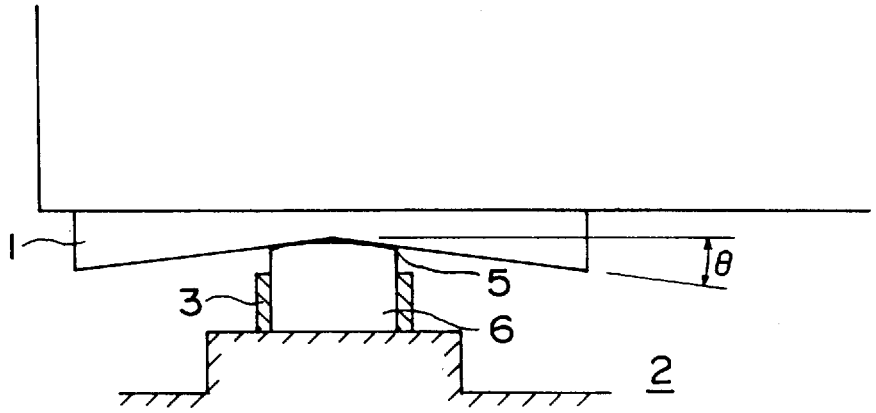
FIGS. 5A and 5B are each a side explanatory view of the apparatus of the present invention and show the relationship between a dish, a bearing element and a holder in a specific example in which a low-friction material has a round trapezoidal surface (FIG. 5A) or a spherical concave surface (FIG. 5B).
Figure 5B:
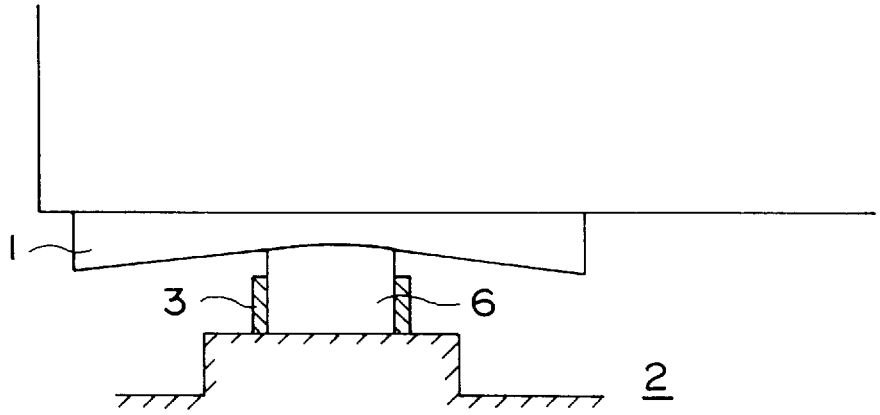
Figure 7A:
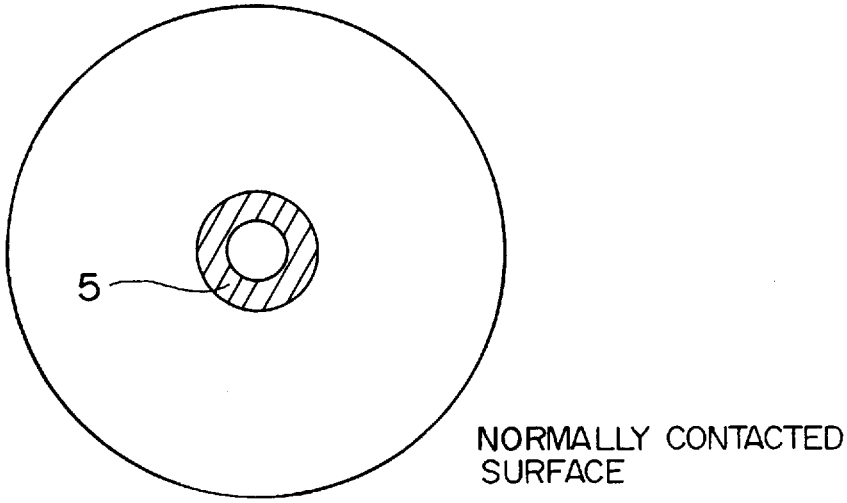
FIG. 7A and 7B are each a plan explanatory view of the apparatus of FIG. 5A or 5B.
Figure 7B:
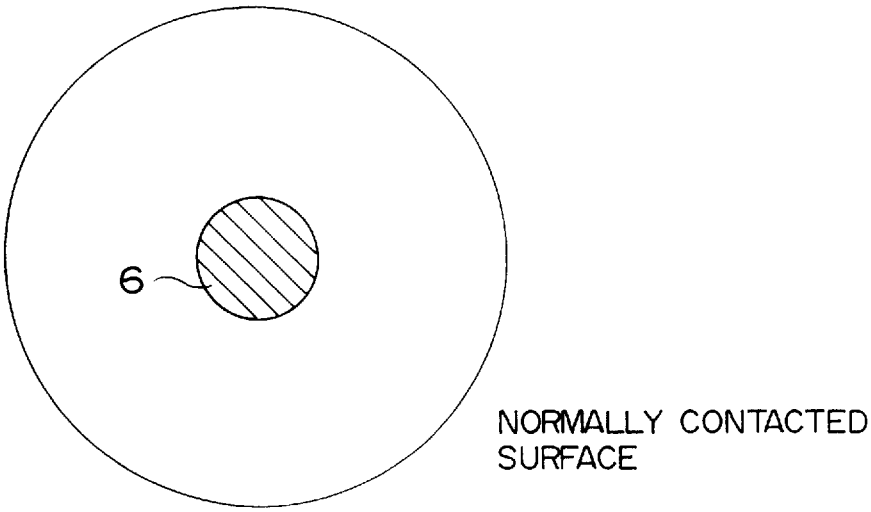

The present invention will be specifically described below with reference to the accompanying drawings. FIGS. 5A and 5B are side views showing the relations among a dish, a bearing element and a holder in the apparatus of the present invention, and FIGS. 7A and 7B are plan views corresponding to FIGS. 5A and 5B, respectively.

A dish 1 has a conical or spherical concave surface in its central portion, and a base 6 having a low-friction material thereon or a base 6 per se made of a low-friction material is mounted on a foundation in such a manner as to be opposed to this concave surface.

In the example shown in FIG. 5A, the low-friction material 5 has a round trapezoidal shape having a surface which is inclined at the same angle ($\Theta$) as the concave surface of the dish 1, and is normally pressed against the central portion of the concave surface of the dish 1.

In the example shown in FIG. 5B, the central portion of the dish 1 has a spherical concave surface. The top end of the base 6 made of a low-friction material has a spherical concave surface having the same radius of curvature as the spherical concave surface of the dish 1, and is normally pressed against the central portion of the concave surface of the dish 1, as shown in FIG. 7B.

The operation of the present invention will be described below with reference to FIGS. 5 to 11. FIGS. 5A, 5B and 7A, 7B show the normal relative position between the bearing element 2 and the dish 1. FIGS. 5A and 5B are side views, while FIGS. 7A and 7B are plan views.

Figure 8A:
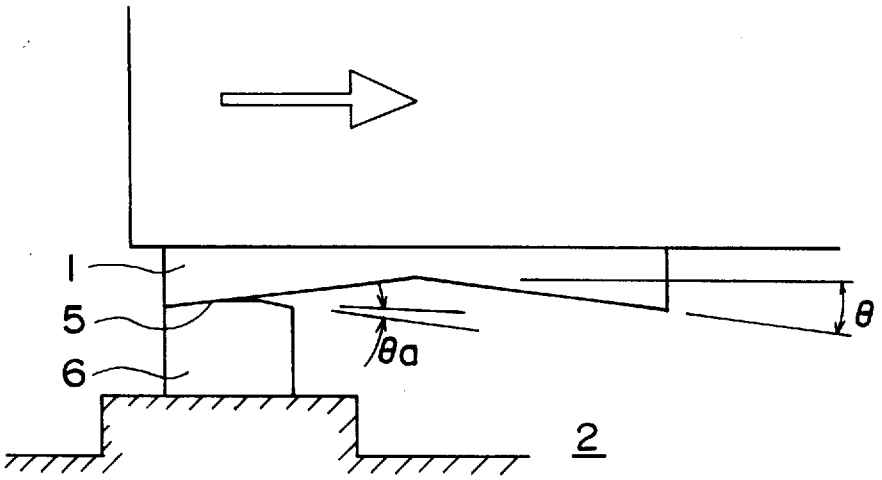
FIGS. 8A and 8B are each a side explanatory view showing a relation in which the relative position between the dish and the low-friction material is varied in the apparatus of FIGS. 5A or 5B.
Figure 8B:
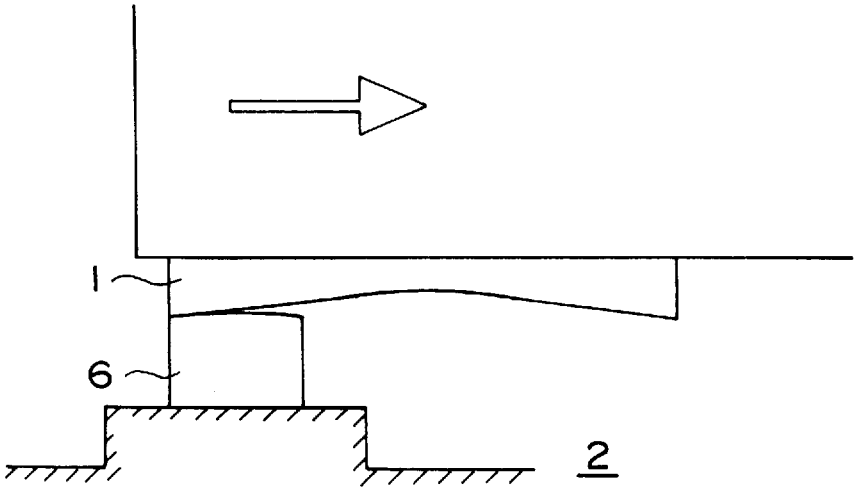
Figure 9A:
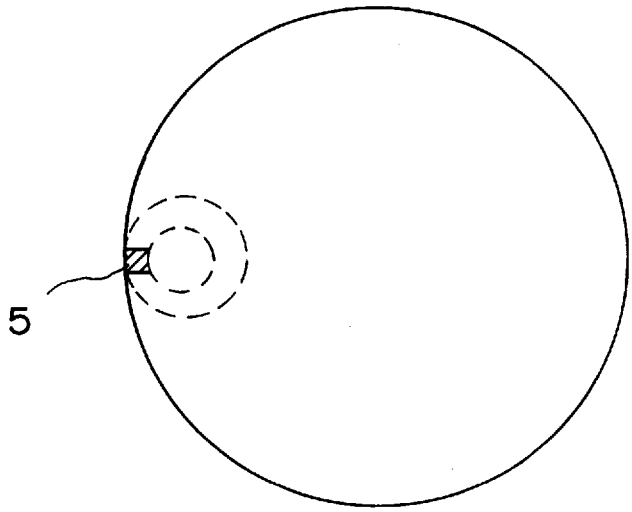
FIG. 9A and 9B are each a plan explanatory view of the apparatus of FIG. 8A or 8B.
Figure 9B:
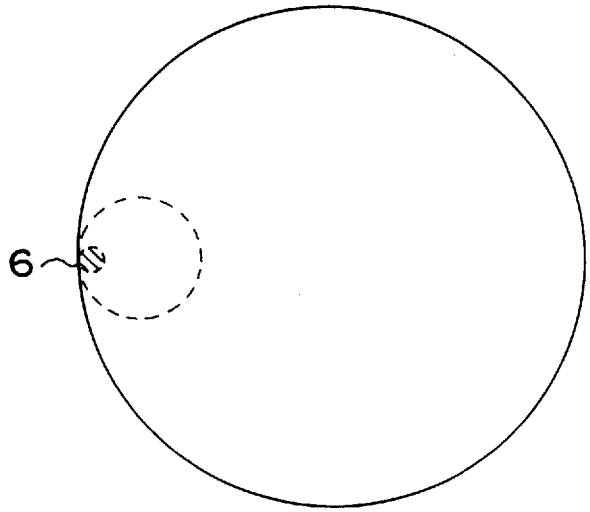

FIG. 8A is a side view showing a state in which the top of the bearing element 2, i.e., the top of the low-friction material 5, is deviated from the center of the dish 1 by vibrations, while FIG. 8B is a side view showing a state in which the spherical convex top of the base 6 made of the low-friction material is deviated from the spherical concave central portion of the dish 1. FIGS. 9A and 9B are plan views corresponding to the respective side views of FIGS. 8A and 8B.

As is apparent from FIGS. 5A, 5B and 8A, 8B, the top of the bearing element which has a round trapezoidal shape has a generatrix whose angle $\Theta a$ of inclination is the same as an angle $\Theta$ of inclination of the conical concave surface of the dish 1. As shown in FIGS. 5A and 7A, the whole surface of the low-friction material 5 of doughnut-like shape is normally maintained in contact with the concave surface of the dish 1.

The bearing element having the spherical convex top is shown in FIG. 5B, and, as shown in FIG. 7B, the whole surface of the spherical convex low-friction material is maintained in contact with the spherical concave surface of the dish 1. Accordingly, the spherical convex top shown in FIG. 5B has a larger area of contact with the concave surface of the dish 1 than the round trapezoidal top of FIG. 5A, and can bear a dish-side load with a large area.

Figure 6:
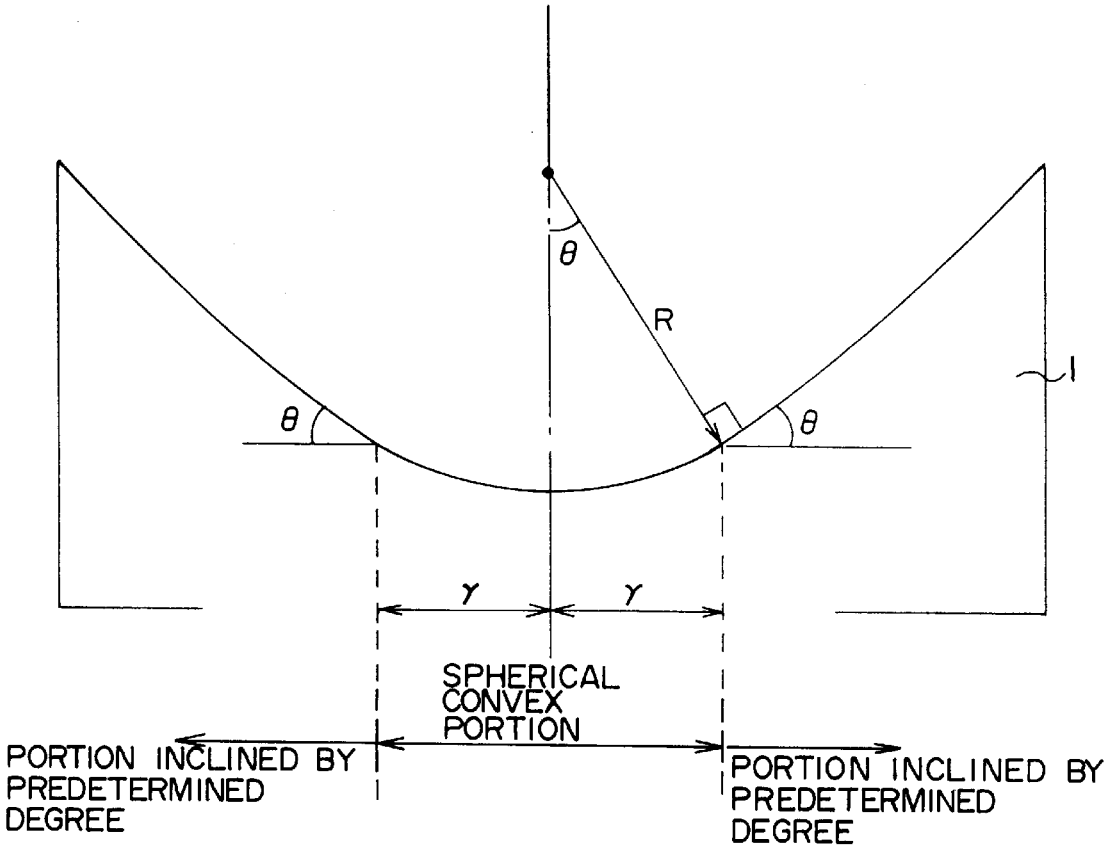
FIG. 6 is an explanatory view of conditions for changeover between the spherical concave surface in the central portion of the dish and a surface of predetermined inclination which surrounds the spherical concave surface.

As shown in FIG. 6, if the concave surface of the dish 1 having a predetermined inclination is made perpendicular to a vector R (radius of curvature) which extends to a spherical concave orbit from the center of the spherical concave surface provided in the central portion of the dish 1, a distance $\gamma$ from the center of the spherical concave surface to the edge of the spherical concave surface is determined as $\gamma = R\sin\Theta$, and the bearing element 2 can smoothly effect a damping operation. If the condition of $\gamma = R\sin\Theta$ is not satisfied, a step is formed and no damping operation can be effected.

In this state, a trigger value for a small vibration such as wind is set. In either case, if a displacement of not less than the set value occurs, the low-friction material on the top of the bearing element 2 comes into contact with the portions inclined by a predetermined degree in the dish 1.

If the bearing element 2 and the dish 1 relatively deviate from each other, the portion of contact between the low-friction material on the top of the bearing element 2 and the concave surface of the dish 1 is limited to an extremely small local area, as shown in FIGS. 8A, 8B and 9A, 9B.

For this reason, since the low-friction material has the characteristic of becoming smaller in coefficient of friction as the load (surface pressure) per unit surface of contact between the low-friction material and the dish 1 becomes larger, the friction force becomes smaller during the occurrence of vibrations shown in each of FIGS. 8A, 8B and 9A, 9B than during the normal state shown in each of FIGS. 5A, 5B and 7A, 7B. Accordingly, in the seismic isolation sliding bearing of the present invention, if the bearing element 2 is located outside the central portion of the dish 1 when the action of the bearing comes to an end (an earthquake ceases), the bearing element 2 returns to its original state with a smaller force than the force required to start the action from the normal state. In other words, the performance of restoration after the end of an earthquake is good.

Moreover, while either the low-friction material 5 or the base 6 is sliding on the dish 1 during an earthquake, a variation in the coefficient of friction related to the displacement velocity occurs within the sliding materials and the occurrence of a large displacement can be restrained by this variation. After the end of the earthquake, since the displacement velocity becomes approximately zero, this force does not act.

Figure 1:
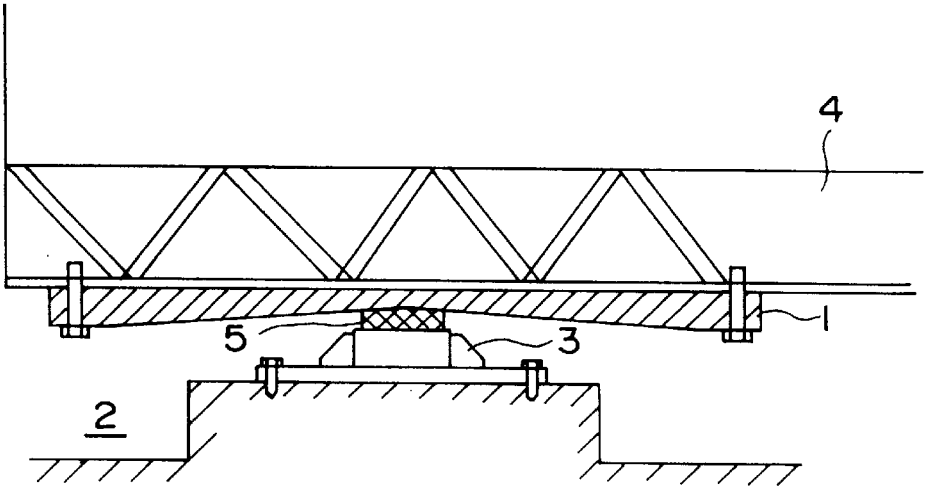
FIG. 1 is an explanatory view of the longitudinal section of one specific example of the seismic isolation bearing of the present invention.

The present invention will be specifically described with reference to FIG. 1. The dish 1 is provided on the bottom of an artificial base 4 of an overlying structure, and a conical concave surface is formed at the center of the dish 1. The bearing element 2 is mounted on a foundation by a holder 3 in such a manner as to be opposed to the central portion of the concave surface from below. Reversely, the bearing element 2 may be mounted face down on an overlying portion, whereas the dish 1 may be mounted face up on an underlying portion.

Figure 2:
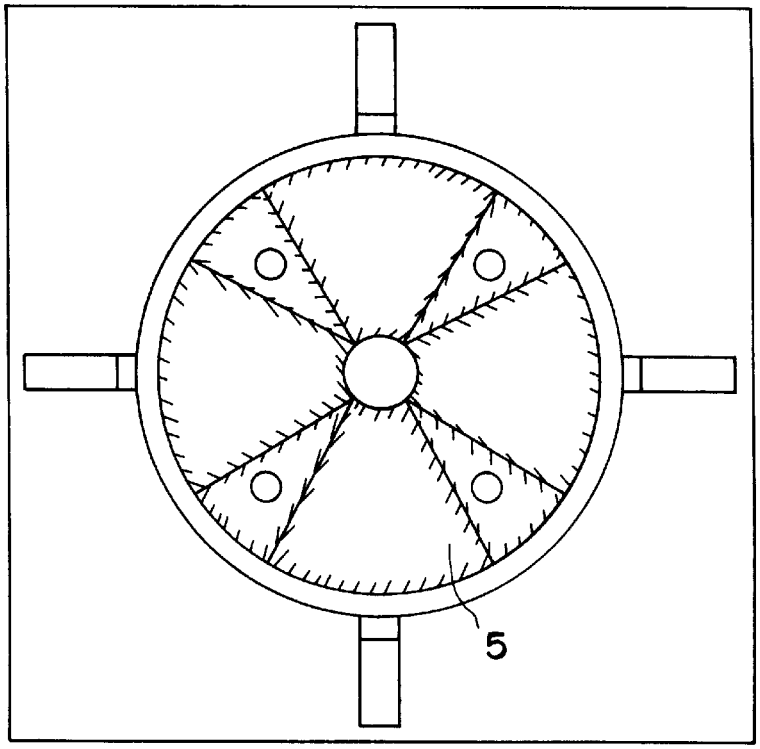
FIG. 2 is a plan view of an example showing the relation between a bearing element and a holder which are used in the apparatus of the present invention.
Figure 3A:
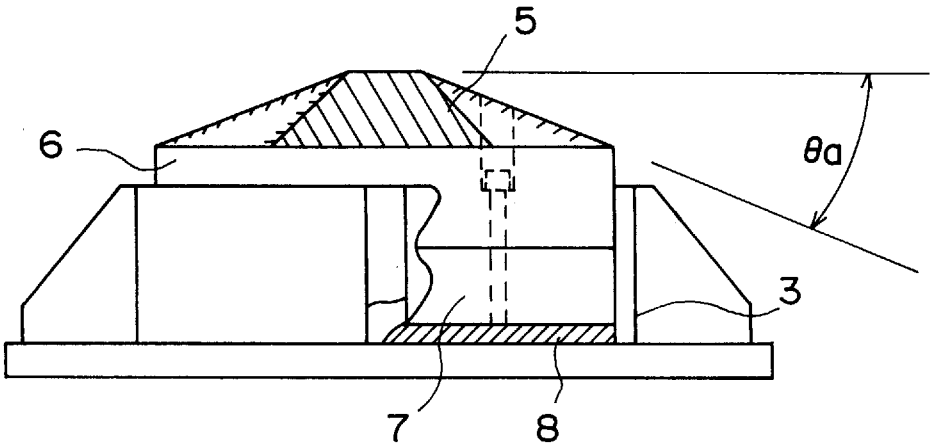
FIG. 3A is a partial cutaway front view of the apparatus of FIG. 2
Figure 3B:
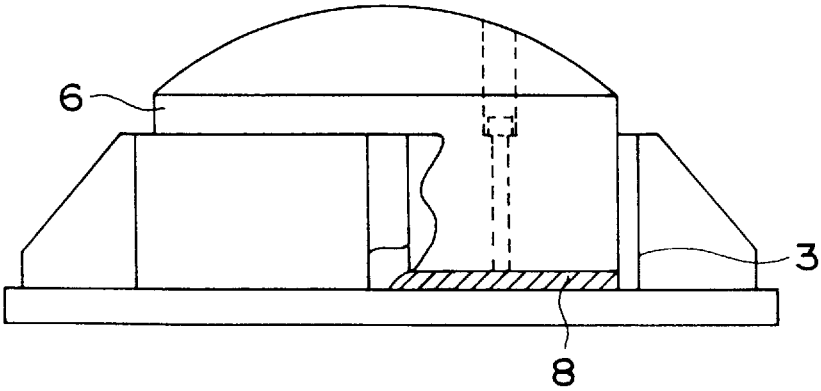
FIG. 3B is a similar view of a specific example in which a low-friction material has a round top.

FIGS. 2, 3A and 3B are detailed explanatory views of the bearing element 2 and the holder 3. FIG. 2 is a plan view showing a case in which the top of the bearing element is truncated, and FIG. 3A is a partial cutaway side view of the bearing element 2 and the holder 3.

FIG. 3B is a partial cutaway side view showing a case in which the top of the bearing element has a sliding surface of spherical convex shape. In this case, the central portion of a dish which is opposed to this bearing element has a spherical concave surface.

Figure 4A:
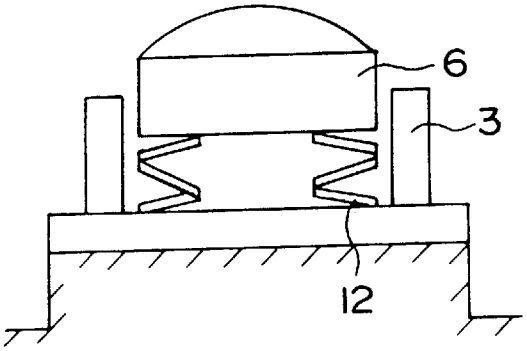
FIGS. 4A to 4C are each a partial cutaway, front explanatory view of a specific example different from the specific example shown in FIG. 3A or 3B.
Figure 4B:
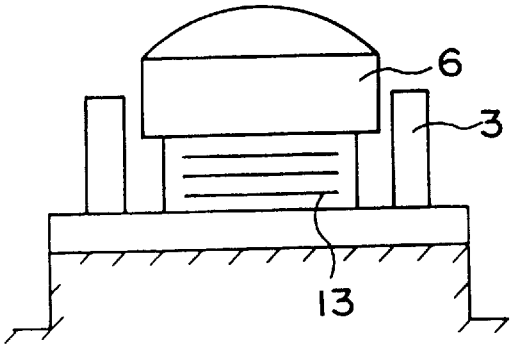

In either case of the above bearing elements, if a disc spring 12 (shown in FIG. 4A) or a laminated rubber or leaf spring 13 (shown in FIG. 4B) is incorporated as an elastic element, a seismic isolation effect for small earthquakes is achieved.

Figure 4C:
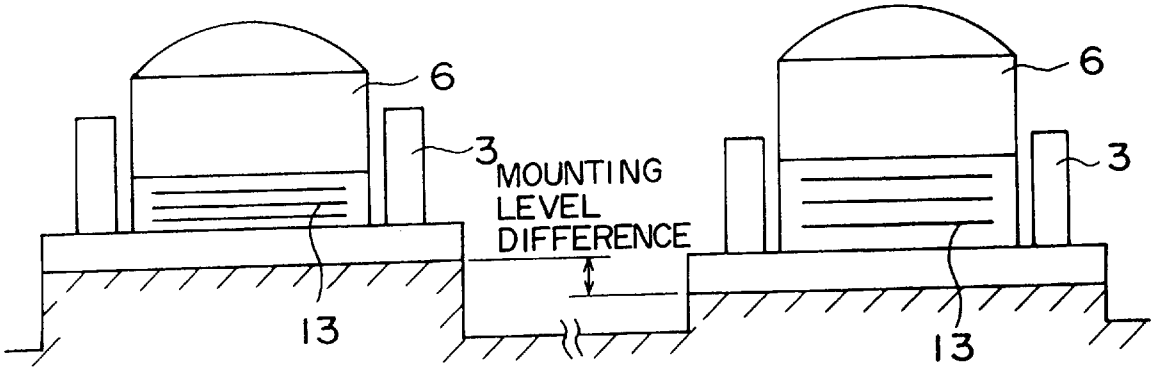

If a plurality of such bearing elements are employed, their mounting positions may deviate from the same plane to a small extent, as shown in FIG. 4(C). The elastic element offsets the differences between the mounting positions of the respective bearings, and also has the effect of reducing upward and downward small vibrations.

As shown in FIGS. 2 and 3A, in the bearing element 2, the low-friction material 5 is secured to the top of the base 6, and a height adjuster 7 and a rubber mat 8 are disposed at the lower end of the base 6. In FIG. 3B, the rubber mat 8 is disposed at the lower end of the base 6 made of the low-friction material, without the height adjuster 7. The bearing element 2 is supported by the holder 3 mounted on the foundation, so as not to move in the horizontal direction.

If the top of the bearing element 2 is truncated, the bearing element 2 has a round trapezoidal shape having a side surface which is inclined at the same angle as the inclination of the generatrix of the conical concave surface of the dish 1.

If the top of the bearing element 2 has a spherical concave surface, the distance $\gamma$ is determined, as described previously, so as to satisfy the condition of $\gamma = R\sin\Theta$ so that the concave surface having the predetermined inclination is made perpendicular to the vector R (radius of curvature) of the spherical concave surface.

The low-friction material used in this invention is a material which is superior in weather resistance and load resistance, such as a thermoplastic resin, particularly, a polytetrafluoroethylene resin, a phenol resin, a high-molecular polyethylene resin, a polyamide resin, a nylon resin, ceramics or the like. There is an example in which a sheet formed from such a low-friction material is bonded to the base 6 and an example in which the base 6 itself is formed of the thermoplastic resin.

Although the height adjuster 7 may be made of the same material as the base 6, a rolled structural steel of JIS G 3101 may also suffice. The rubber mat 8 serves to cushion the difference in height between installed bearing portions and also to damp upward and downward shocks during an earthquake.

A structure in which the low-friction material 5 is not employed and the base 6 is in direct contact with the concave surface of the dish 1 may also be adopted according to the set value of the magnitude of a vibration at which this seismic isolator starts its operation.

Because of the structure of the seismic isolation bearing of the present invention, if a term proportional to velocity is ignored from among various characteristics relative to the seismic isolation action, the acceleration of the response to vibration is determined by a resisting force due to the inclination of the dish and the coefficient of friction between a low-friction material and the concave surface of the base, and it may not be varied by factors other than these factors for any seismic wave input.

Figure 12:
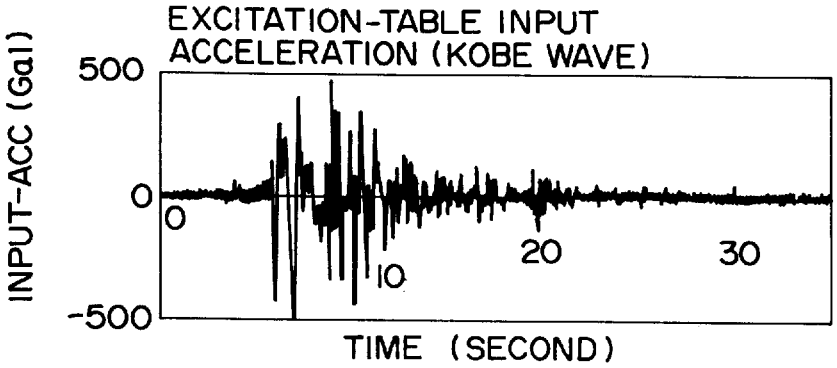
FIG. 12 is a graph showing a variation in excitation-table input acceleration.
Figure 13:
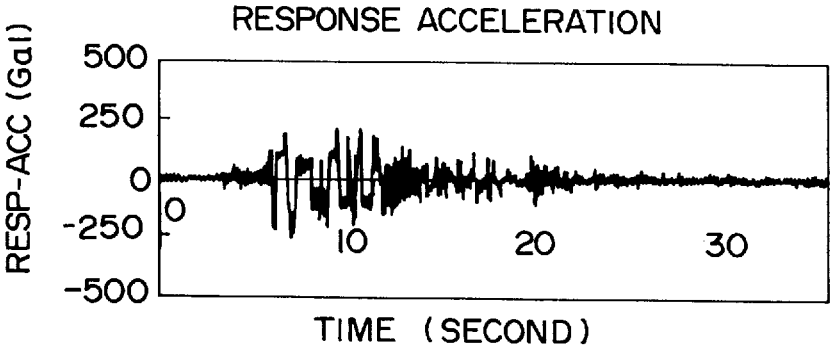
FIG. 13 is a graph showing a variation in response acceleration on the seismic isolation bearing of the present invention.
Figure 14:
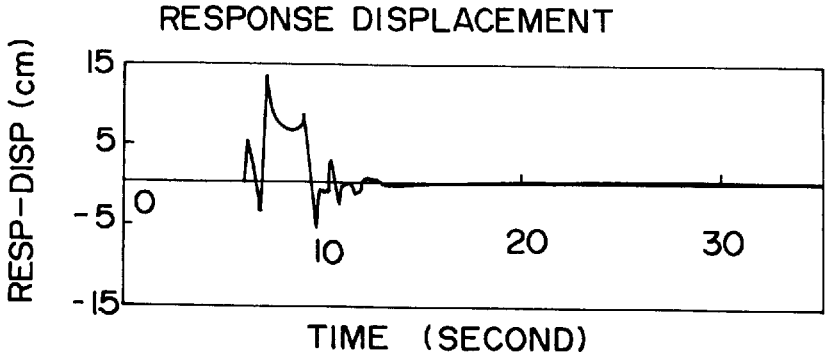
FIG. 14 is a graph showing the relative displacement between the seismic isolation bearing of the present invention and an excitation table.

The result of an experiment performed with the present invention is shown in FIGS. 12 to 14. FIG. 12 shows the relation between time and the acceleration (corresponding to the seismic wave of the Kobe earthquake) input by an excitation table (not shown). Although the excitation-table input acceleration in the graph is not more than 500 Gal, it has been theoretically confirmed that equivalent response acceleration is obtained for an input exceeding 500 Gal.

It can be seen from the response displacement of FIG. 14 that the seismic isolation bearing is restored to its original position after the end of the earthquake. Although a relative displacement occurs when the elapsed time is 5–12 sec, no relative displacement occurs before and after that period. It is apparent, therefore, that the seismic isolation bearing does not operate in the acceleration range of from a comparatively small scale to a medium scale, that is, the seismic isolation bearing has a trigger function.

Figure 15:
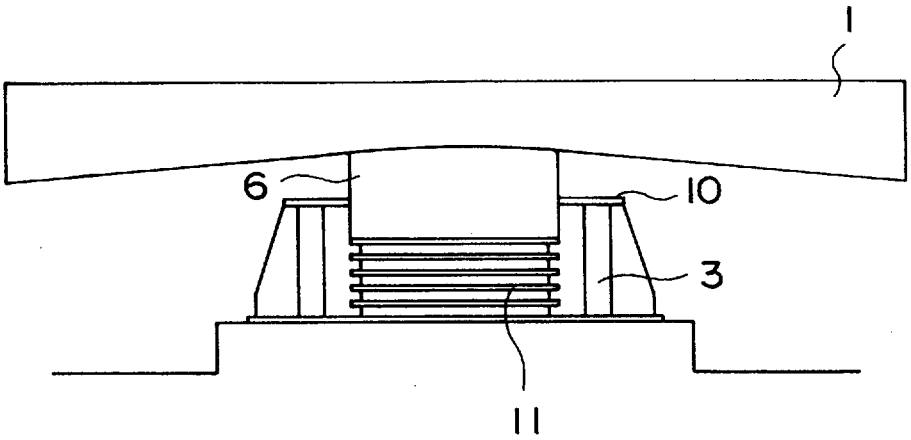
FIG. 15 is an explanatory view showing the construction of an embodiment having a laminated rubber at the bottom of a base.
Figure 16:
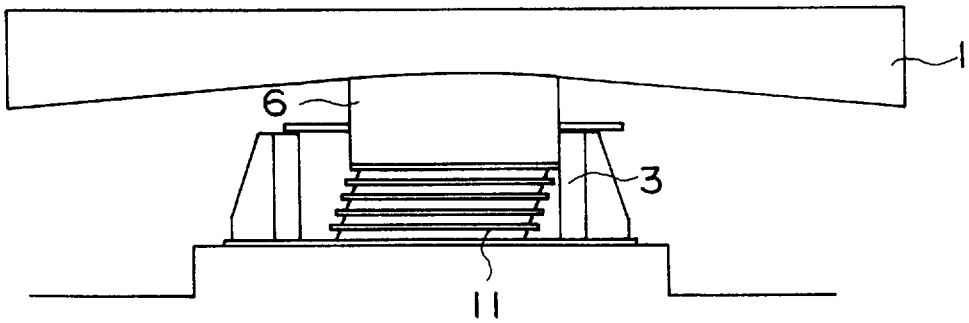
FIG. 16 is an explanatory view of the operation of the apparatus of FIG. 15 to which small vibrations are applied.
Figure 17:
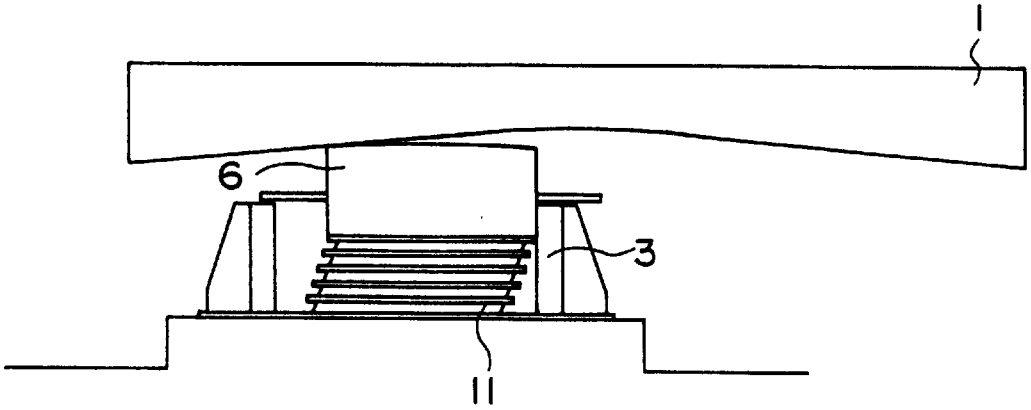
FIG. 17 is an explanatory view of the operation of the apparatus of FIG. 15 to which large vibrations are applied.

The example shown in FIGS. 15 to 17 has the holder 3 having an inner diameter which is large compared to the diameter of the base 6 made of a low-friction wear-resistant thermoplastic resin in the bearing element which is opposed to the dish 1.

A laminated rubber 11 is disposed in the holder 3 and the base 6 made of the low-friction material is placed on the laminated rubber 11, and a lid 10 is arranged to prevent rainwater or dust from entering the gap between the base 6 and the holder 3.

The operation of this apparatus will be described below. If a vibration is small, no sliding phenomenon occurs between the dish 1 and the base 6 as shown in FIG. 16, and as much a seismic isolation action is obtained as the laminated rubber 11 can be deformed inside the holder 3.

If the vibration continues to become larger, the deformation of the laminated rubber 11 reaches its upper limit due to the holder 3 as shown in FIG. 17, and a sliding phenomenon occurs between the dish 1 and the base 6, so that a seismic isolation action due to sliding is obtained in addition to a seismic isolation action due to the deformation of the laminated rubber 11.

Although, in any of the examples shown in FIGS. 15 to 17, the dish 1 is disposed above the bearing element and they are opposed to each other, it is of course possible to obtain a similar seismic isolation effect by adopting an arrangement in which the dish 1 is disposed below the bearing element and the bearing element is opposed to the dish 1 from above in the downward direction.

Figure 10:
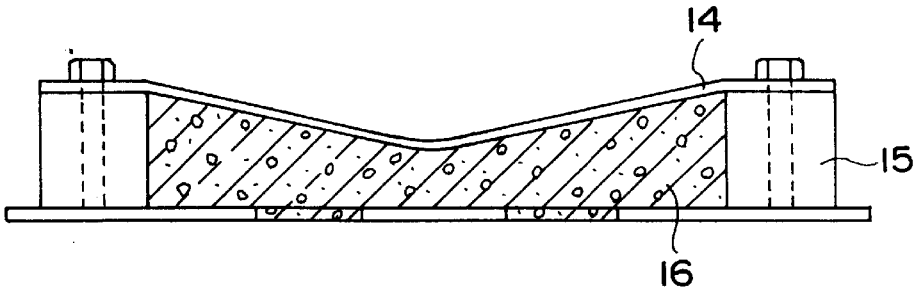
FIG. 10 is an explanatory view showing the cross section of a dish having a spherical concave surface in its central portion and a method of manufacturing the dish.
Figure 11:
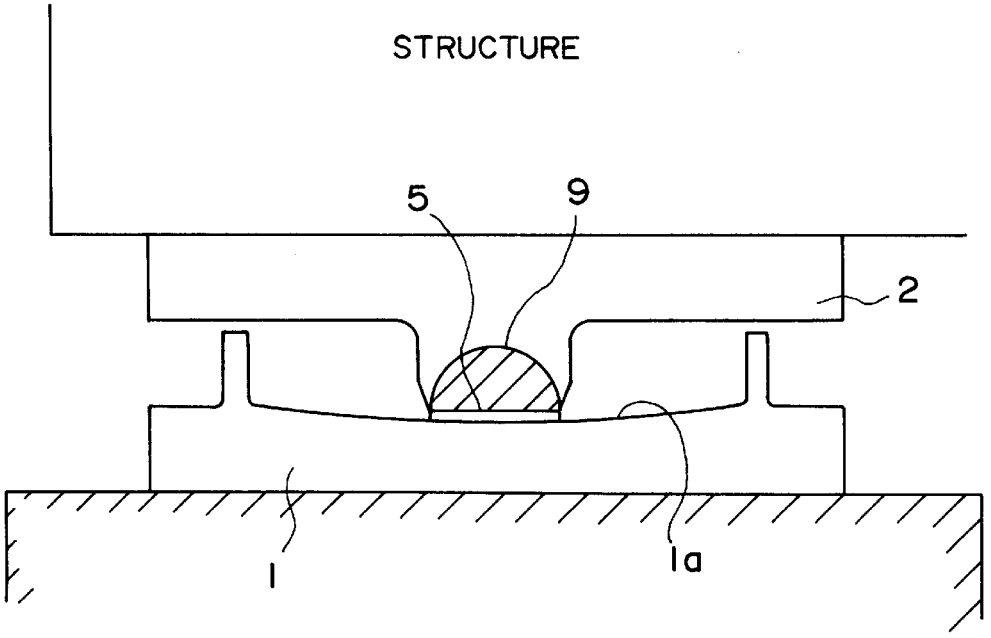
FIG. 11 PRIOR ART
FIG. 11 is an explanatory view of the longitudinal section of a conventional seismic isolation sliding bearing.

FIG. 10 shows one example of the construction of the dish according to this invention and an example of a manufactured dish.

In this construction, a spherical concave sheet is produced from a smooth and rust-free thin steel sheet, such as a stainless steel sheet, and a concrete or high-strength resin layer is formed on the reverse surface of the spherical concave sheet.

An example of a manufactured dish will be specifically described with reference to FIG. 10. A smooth stainless steel sheet (3 mm thick) 14 which is a low-friction steel sheet formed into a spherical concave shape by means of a press is secured to one side of a form 15 made of plastic or the like, and concrete or a high-strength resin 16 is injected through the holes of a base plate on the opposite side of the mold 15, thereby forming the dish 1.

As described above, the seismic isolation bearing of the present invention neither resonates to the vibration period of any earthquake nor causes a large oscillation during a normal small vibration, but has a restoring force because of its structure which enables the bearing element to readily return to its original position after an earthquake ceases.

What is claimed is:

1. A seismic isolation sliding bearing for a structure, comprising a dish, bearing plate, having a spherical concave surface in its central portion and a trapezoidal concave surface inclined by a predetermined degree around said spherical concave surface, and a non-rotatable bearing element opposed to said bearing plate said bearing element including a base made of a low-friction and wear-resistant thermoplastic resin and having a spherical convex sliding surface, and a holder which holds said base so as to press said base against said concave surface of said bearing plate.

2. A seismic isolation sliding bearing for a structure according to claim 1, wherein a radius of curvature of said spherical concave surface in said central portion of said bearing plate and a radius of curvature of a spherical convex surface of said bearing element satisfies the following equation:

$$\gamma = R\sin\Theta,$$

where $\gamma$: distance from the center of said spherical concave surface or said spherical convex surface to the edge of said spherical concave surface or said spherical convex surface;

R: radius of curvature of said spherical concave surface or the radius of curvature of said spherical convex surface; and $\Theta$: angle of predetermined inclination.

3. A seismic isolation sliding bearing for a structure according to claim 1, wherein said concave surface of said bearing plate is made of smooth stainless steel and a reverse side of said concave surface has a reinforcement material made of concrete or a high-strength resin.

4. A seismic isolation sliding bearing for a structure according to claim 1, wherein said sliding bearing has an elastic member at a bottom Portion of said bearing plate, or at a bottom Portion of said base of said bearing element.

5. A seismic isolation sliding bearing for a structure according to claim 1, wherein said sliding bearing has a laminated rubber member at a bottom portion of said bearing plate, or at a bottom portion of said base of said bearing element.

6. A seismic isolation sliding bearing for a structure, comprising a bearing plate having a conical concave surface having a predetermined inclination and a non-rotatable bearing element opposed to said bearing plate, said bearing element having a top portion with a truncated cone shape having a generatrix whose angle is the same as the inclination of the bearing plate and enables a trigger valve to be set during a normal state and including a base having a low friction material fixed to an end thereof and a holder which holds said base so as to press said low friction material against said concave surface of said bearing plate.

7. A seismic isolation sliding bearing for a structure according to claim 6, wherein said sliding bearing has an elastic member at a bottom portion of said bearing plate, or at a bottom portion of said base of said bearing element.

8. A seismic isolation sliding bearing for a structure according to claim 6, wherein said sliding bearing has a laminated rubber member at a bottom portion of said bearing plate, or at a bottom portion of said base of said bearing element.

9. A seismic isolation sliding bearing for a structure according to claim 6, wherein said concave surface of said bearing plate is made of smooth stainless steel and a reverse side of said concave surface has a reinforcement material made of concrete or a high-strength resin.

10. A seismic isolation sliding bearing for a structure, comprising a bearing plate having a conical concave surface having a predetermined inclination, a non-rotatable bearing element opposed to said bearing plate, said bearing element including a base having a low-friction material fixed to an end thereof and a holder which holds said base so as to press said low-friction material against said concave surface of said bearing plate, and an elastic member provided at a bottom portion of said bearing plate or at a bottom portion of said base of said bearing element.

11. A seismic isolation sliding bearing for a structure, comprising a bearing plate having a conical concave surface having a predetermined inclination, a non-rotatable bearing element opposed to said bearing plate, said bearing element including a base having a low-friction material fixed to an end thereof and a holder which holds said base so as to press said low-friction material against said concave surface of said bearing plate, and a laminated rubber member provided at a bottom portion of said bearing plate or at a bottom portion of said base of said bearing element.

12. A seismic isolation sliding bearing for a structure, comprising a bearing plate having a conical concave surface having a predetermined inclination, said concave surface being made of smooth stainless steel and a reverse side of said concave surface has a reinforcement material made of concrete or a high-strength resin, and a non-rotatable bearing element opposed to said bearing plate, said bearing element including a base having a low-friction material fixed to an end thereof and a holder which holds said base so as to press said low-friction material against said concave surface of said bearing plate.

* * * * *

UNITED STATES PATENT AND TRADEMARK OFFICE

CERTIFICATE OF CORRECTION

PATENT NO. : 5 867 951

DATED : February 9, 1999

INVENTOR(S) : Daisuke YAGUCHI et al

It is certified that error appears in the above-identified patent and that said Letters Patent is hereby corrected as shown below:

Column 7, Line 26; change "comprising a dish, bearing plate," to ---comprising a bearing plate---.

Column 7, Line 30; change "bearing plate said" to ---bearing plate, said---.

Column 7, Line 60; change "Portion" to ---portion---.

Column 7, Line 61; change "Portion" to ---portion---.

Signed and Sealed this

Tenth Day of August, 1999

*Attest:*

Q. TODD DICKINSON

*Attesting Officer*

*Acting Commissioner of Patents and Trademarks*